US012096890B2

(12) United States Patent
Gandemo et al.

(10) Patent No.: US 12,096,890 B2
(45) Date of Patent: Sep. 24, 2024

(54) DISPENSER FOR A ROLL OF ABSORBENT PAPER WEB MATERIAL

(71) Applicant: Essity Hygiene and Health Aktiebolag, Gothenburg (SE)

(72) Inventors: Tomas Gandemo, Gothenburg (SE); Susanne Gungner, Gothenburg (SE); Mattias Bengtsson, Gothenburg (SE); Thomas Geertsen, Borlänge (SE); Antonio Källgren, Borlänge (SE); Marcus Kullman, Borlänge (SE)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 0 days.

(21) Appl. No.: 17/617,821

(22) PCT Filed: Oct. 26, 2020

(86) PCT No.: PCT/EP2020/080048
§ 371 (c)(1),
(2) Date: Dec. 9, 2021

(87) PCT Pub. No.: WO2021/089356
PCT Pub. Date: May 14, 2021

(65) Prior Publication Data

US 2022/0225848 A1 Jul. 21, 2022

(30) Foreign Application Priority Data

Nov. 8, 2019 (EP) ..... 19208044

(51) Int. Cl.
*A47K 10/38* (2006.01)
*A47K 10/32* (2006.01)

(52) U.S. Cl.
CPC .. *A47K 10/3818* (2013.01); *A47K 2010/3206* (2013.01); *A47K 2010/3233* (2013.01)

(58) Field of Classification Search
CPC ..... A47K 10/3818; A47K 2010/3206; A47K 2010/3233
(Continued)

(56) References Cited

U.S. PATENT DOCUMENTS 995,203 A * 6/1911 Thomas et al. ..... B65D 47/265 174/152 G
2,382,659 A 8/1945 Olson
(Continued)

FOREIGN PATENT DOCUMENTS

CA 2482014 A1 * 6/2003 ..... A47K 10/3818
CA 2456492 A1 8/2004
(Continued)

OTHER PUBLICATIONS

International Search Report (PCT/ISA/210) and Written Opinion (PCT/ISA/237) mailed on Jan. 26, 2021, by the European Patent Office as the International Searching Authority for International Application No. PCT/EP2020/080048.
(Continued)

*Primary Examiner* — Rakesh Kumar
(74) *Attorney, Agent, or Firm* — Buchanan Ingersoll & Rooney PC

(57) ABSTRACT

A dispenser for a roll of rolled up absorbent paper web material, the dispenser, in a closed state, including an outer casing enclosing a roll compartment for housing a roll, and a dispensing opening extending from the roll compartment to the outside of the outer casing along a dispensing axis of the dispenser, the outer casing including an outer lid assuming a closed position when the dispenser is in the closed state. The dispenser further including an inner lid, which, in the closed state of the dispenser, is arranged between the roll compartment and the outer lid, wherein the inner lid defines a first threading opening through the inner lid along the
(Continued)

dispensing axis, the first threading opening including a first dispensing opening portion; and the outer lid defines a second threading opening through the outer lid along the dispensing axis.

29 Claims, 6 Drawing Sheets

(58) Field of Classification Search
USPC ..... 221/63; 242/593; 220/253, 265, 269, 220/258
See application file for complete search history.

(56) References Cited

U.S. PATENT DOCUMENTS 3,843,017 A 10/1974 Harrison
3,973,695 A 8/1976 Ames
4,181,218 A 1/1980 Cox
4,262,816 A * 4/1981 Margulies ..... B65D 83/0805 225/106
4,274,573 A 6/1981 Finkelstein
4,462,507 A 7/1984 Margulies
4,648,530 A 3/1987 Granger
4,760,970 A * 8/1988 Larsson ..... A47K 10/3818 242/422.5
4,905,868 A 3/1990 Beane et al.
4,925,067 A * 5/1990 Zemlo ..... B65D 47/286 222/561
5,065,924 A * 11/1991 Granger ..... A47K 10/3818 225/53
5,072,849 A * 12/1991 Blau ..... B65D 47/265 D34/1
5,141,171 A 8/1992 Yang
5,211,308 A 5/1993 Decker et al.
5,215,211 A 6/1993 Eberle
5,219,126 A 6/1993 Schutz
5,269,432 A * 12/1993 Beckertgis ..... B65D 51/24 215/250
5,273,184 A 12/1993 Rizzuto
5,346,064 A 9/1994 Rizzuto
5,370,338 A 12/1994 Lewis
5,383,582 A * 1/1995 Baxter ..... B65D 47/265 222/548
5,480,060 A 1/1996 Blythe
5,507,419 A * 4/1996 Martin ..... B65D 47/265 222/548
5,609,269 A 3/1997 Behnke et al.
5,706,986 A 1/1998 Brandenburg et al.
5,715,971 A 2/1998 Morand
5,762,286 A 6/1998 Schutz
5,762,287 A 6/1998 Schutz
5,765,718 A * 6/1998 Grasso ..... A47K 10/3818 242/593
5,769,354 A * 6/1998 Lindh ..... A47K 10/3836 242/593
5,785,274 A 7/1998 Johnson
5,857,642 A 1/1999 Zinnbauer
6,082,663 A * 7/2000 Tramontina ..... A47K 10/3818 242/593
6,129,240 A 10/2000 Morand
6,138,867 A 10/2000 Stelmack
6,145,782 A * 11/2000 King ..... A47K 10/3818 242/593
6,158,614 A * 12/2000 Haines ..... A47K 10/3818 221/33
6,179,235 B1 1/2001 King
6,267,321 B1 7/2001 Tramontina
6,328,252 B1 * 12/2001 Neveu ..... A47K 10/3818 242/593
D467,106 S * 12/2002 Bohay ..... A47K 10/3818 D6/523
6,575,397 B1 * 6/2003 Tramontina ..... A47K 10/3818 242/593
6,592,001 B2 * 7/2003 Lewis ..... A47K 10/3818 221/33
6,869,041 B1 3/2005 Allegre et al.
6,964,395 B1 * 11/2005 Lewis ..... A47K 10/3818 242/593
7,040,568 B2 5/2006 Lewis et al.
7,111,805 B2 9/2006 Notarnicola
7,131,609 B1 * 11/2006 Lewis ..... A47K 10/3818 242/593
7,275,655 B2 10/2007 Duff
7,275,672 B2 10/2007 Haen et al.
7,293,738 B2 * 11/2007 Grebonval ..... A47K 10/38 242/597.7
7,530,460 B2 * 5/2009 Lewis ..... B65D 83/0805 221/302
7,731,057 B2 6/2010 Evans et al.
7,806,292 B2 * 10/2010 Simkins ..... A47K 10/3818 221/39
7,878,368 B2 2/2011 Friesen et al.
10,149,578 B2 12/2018 Kreuter
10,231,580 B2 3/2019 Rozek et al.
11,172,794 B2 * 11/2021 Kim ..... A47K 10/3818
11,224,314 B2 * 1/2022 Albrecht ..... A47K 10/38
2002/0056718 A1 5/2002 Paukov et al.
2003/0080018 A1 5/2003 Nally
2003/0122031 A1 7/2003 Tramontina et al.
2003/0159533 A1 8/2003 Fauth
2008/0105699 A1 5/2008 Wong et al.
2008/0110918 A1 5/2008 Lee
2008/0217453 A1 9/2008 Malecot et al.
2008/0283546 A1 * 11/2008 Neveu ..... A47K 10/3818 221/45
2008/0290210 A1 11/2008 Tramontina et al.
2009/0045211 A1 * 2/2009 Friesen ..... A47K 10/3818 221/45
2010/0078443 A1 4/2010 Hoefing et al.
2011/0139807 A1 * 6/2011 Ray ..... A47K 10/3818 221/1
2011/0284570 A1 * 11/2011 Hatter ..... A47K 10/38 221/26
2012/0145737 A1 6/2012 Ray et al.
2012/0256037 A1 10/2012 Nordlund
2014/0246469 A1 9/2014 Forsaeus et al.
2014/0263387 A1 9/2014 Muehl et al.
2014/0367400 A1 12/2014 Crudge et al.
2015/0053712 A1 * 2/2015 Laflin ..... A47K 10/3818 221/45
2015/0305579 A1 10/2015 Azelton et al.
2016/0000276 A1 * 1/2016 Rozek ..... A47K 10/3818 242/593
2016/0227971 A1 8/2016 Granger
2018/0192833 A1 7/2018 Roeder

FOREIGN PATENT DOCUMENTS

CZ 200338 A3 8/2003
DE 202004006727 U1 10/2004
EP 0026319 A1 4/1981
EP 0068722 A2 1/1983
EP 0107487 A1 5/1984
EP 0117074 A2 8/1984
EP 0441529 A2 8/1991
EP 0480848 A1 4/1992
EP 0534600 A2 3/1993
EP 0642317 A1 3/1995
EP 0740921 A1 11/1996
EP 0836825 A1 4/1998
EP 0861042 A1 9/1998
EP 0960066 A1 12/1999
EP 0999990 A1 5/2000
EP 1021118 A1 7/2000
EP 1066787 A1 1/2001
EP 1109480 A1 6/2001
EP 1206919 A2 5/2002
EP 1333744 A1 8/2003
EP 1465517 A1 10/2004
EP 1496783 A1 1/2005
EP 1773168 A1 4/2007

(56) References Cited

FOREIGN PATENT DOCUMENTS

| | | | | | |
|---|---|---|---|---|---|
| EP | 1881778 | A1 | | 1/2008 | |
| EP | 1893513 | A1 | | 3/2008 | |
| EP | 1951096 | A1 | | 8/2008 | |
| EP | 2073677 | A2 | | 7/2009 | |
| EP | 2152133 | A2 | | 2/2010 | |
| EP | 2220984 | A2 | | 8/2010 | |
| EP | 2394551 | A1 | | 12/2011 | |
| EP | 2512314 | A1 | | 10/2012 | |
| EP | 2220984 | A3 | | 12/2012 | |
| EP | 2583603 | A1 | | 4/2013 | |
| EP | 2648588 | A2 | | 10/2013 | |
| EP | 2750569 | A1 | | 7/2014 | |
| EP | 2782486 | A2 | | 10/2014 | |
| EP | 2903491 | A1 | | 8/2015 | |
| EP | 3040005 | A1 | | 7/2016 | |
| EP | 3046453 | A1 | | 7/2016 | |
| EP | 3133969 | A1 | | 3/2017 | |
| EP | 3135166 | A1 | | 3/2017 | |
| EP | 3241471 | A1 | | 11/2017 | |
| EP | 3260029 | A1 | | 12/2017 | |
| EP | 3335605 | A1 | * | 6/2018 | ..... A47K 10/3818 |
| EP | 3818918 | A1 | * | 5/2021 | ..... A47K 10/3818 |
| FR | 2417282 | A1 | | 9/1979 | |
| FR | 2669818 | A1 | | 6/1992 | |
| GB | 1438240 | A | | 6/1976 | |
| GB | 1476303 | A | | 6/1977 | |
| GB | 2145693 | A | | 4/1985 | |
| GB | 2244472 | A | * | 12/1991 | ..... A47K 10/3818 |
| GB | 2390357 | A | | 1/2004 | |
| SE | 519198 | C2 | | 1/2003 | |
| SE | 519199 | C2 | | 1/2003 | |
| SE | 522636 | C2 | | 2/2004 | |
| WO | 9918835 | A1 | | 4/1999 | |
| WO | 2006124429 | A1 | | 11/2006 | |
| WO | WO-2007057537 | A1 | * | 5/2007 | ..... A47K 10/3818 |
| WO | 2008048151 | A1 | | 4/2008 | |
| WO | WO-2014058323 | A1 | * | 4/2014 | ..... A47K 10/3818 |
| WO | WO-2018063219 | A1 | * | 4/2018 | ..... A47K 10/36 |
| WO | 2018137992 | A1 | | 8/2018 | |
| WO | 2018231776 | A1 | | 12/2018 | |

OTHER PUBLICATIONS

Office Action issued on Jun. 29, 2023, in corresponding Colombian Patent Application No. NC2022/0000096. (12 pages).

Office Action issued in Colombian Patent Application No. NC2022/0000096, dated Jun. 29, 2023 (12 pages).

Examination report issued in Australian Patent Application No. 2020379090, dated Feb. 9, 2023 (3 pages).

Office Action issued in Chilean Patent Application No. 2021-003604, dated Apr. 13, 2023 (14 pages).

Office Action issued in Chilean Patent Application No. 2021-003604, dated Jul. 10, 2023 (10 pages).

* cited by examiner

DISPENSER FOR A ROLL OF ABSORBENT PAPER WEB MATERIAL

TECHNICAL FIELD

The present disclosure relates to a dispenser for a roll of rolled up absorbent paper web material. The dispenser comprises an outer casing comprising an outer lid. In a closed state of said dispenser the outer casing encloses a roll compartment for housing a roll. The dispenser further comprises a dispensing opening extending from said roll compartment to the outside of said outer casing along a dispensing axis of said dispenser.

BACKGROUND

A dispenser for rolls of absorbent paper web material, such as hygiene paper or wiping paper, may comprise a casing which, when the dispenser is in use, encloses a roll compartment for housing a roll. The absorbent paper web material is to be fed out from the casing via a dispensing opening.

Generally, it may be desired that the casing forms a completely closed casing around the roll when the dispenser is in use, that is, closed apart from the dispensing opening. This is so that the roll of absorbent web material is protected from the outside, e.g. from splashing of water or from users soiling the roll when attempting to withdraw web material from the roll.

In view of the need for protecting the roll, it may be desired to provide a dispensing opening having a relatively small open area.

In particular, it may be desired to provide a dispenser where the dispensing opening has a restricted opening so as to hinder access to the web shaped material via the dispensing opening. Instead, dispensing is enabled by a leading tail of the web material being arranged to protrude from the dispensing opening, such that the tail may be reached by a user. The dispenser is configured for any cutting or tearing of web material to take place outside of the dispensing opening, e.g. outside of the dispenser. Accordingly, it is ensured that a tail of web material is always present in the dispensing opening, enabling the user to withdraw web material from the dispenser.

In addition, the dispensing opening may be designed to take different dispensing requirements into account.

For example, it may be required that the dispenser shall provide automatic sheet-by-sheet dispensing of perforated web material.

To this end, the dispenser may be provided with a nozzle, forming said dispensing opening, and which nozzle is designed to enable that pulling of a leading tail of perforated web material arranged in said nozzle results in the web rupturing along a perforation line, so as to provide the user with a sheet including said leading tail, while simultaneously ensuring that the following sheet, i.e. the trailing portion of the web material, after the ruptured perforation, is fed to a position protruding from said nozzle (from the dispensing opening), so that a next sheet may be subsequently drawn from the dispenser.

Dispensers such as those exemplified in the above require initial threading meaning that, after refill of a dispenser with a new roll, a leading tail of the web material of the new roll is positioned so as to protrude from the dispensing opening, enabling a user to pull web material from the dispenser. When the dispensing opening and/or the nozzle if present have a relatively restricted open area, the threading may be difficult and/or time-consuming. In particular, the threading may require that the tail of the web material is twisted or otherwise manipulated to enable threading thereof through the dispensing opening.

It is desired to provide a dispenser comprising a dispensing opening which dispensing opening is easy to refill.

SUMMARY

The dispenser may be used for housing rolls having a core or for coreless rolls. The rolls may comprise absorbent paper, in particular toilet paper or household paper.

In a first aspect, there is provided a dispenser for a roll of rolled up absorbent paper web material. In a closed state, the dispenser comprises an outer casing enclosing a roll compartment for housing a roll, and a dispensing opening extending from the roll compartment to the outside of said outer casing. The dispensing opening defines a dispensing axis of the dispenser. As such, the dispensing axis is defined by the extension of the dispensing opening from the roll compartment to the outside of the outer casing. The outer casing comprises an outer lid, which, in the closed state, assumes a closed position.

The dispenser comprises an inner lid which, in said closed state of the dispenser, is arranged between said roll compartment and said outer lid, which is in its closed position. Said inner lid defines a first threading opening through said inner lid along said dispensing axis, said first threading opening comprising a first dispensing opening portion. Said outer lid defines a second threading opening through said outer lid along said dispensing axis, said second threading opening comprising a second dispensing opening portion. When the dispenser is in said closed state, the first threading opening and the second threading opening are arranged in a partly overlapping relationship so as to form said dispensing opening by said first dispensing opening portion and said second dispensing opening portion.

By a dispenser as set out in the above, the threading of the dispenser to a use condition in which a tail of web material protrudes from the dispensing opening may be performed in two consecutive steps. In a first step, the threading may involve threading a tail of material through the first threading opening, i.e. in a direction along the dispensing axis, such that the tail extends through the first threading opening. Thereafter, the tail of material may be moved in a direction or directions perpendicular to said dispensing axis, so as to position the tail of material at the first dispensing opening portion. In a second step, the tail of material may be threaded through the second threading opening.

In a closed state of the dispenser, the first threading opening and the second threading opening are arranged in a partly overlapping relationship so as to form the dispensing opening of the dispenser by the first dispensing opening portion and the second dispensing opening portion. Hence, a tail threaded through the first and second threading opening will, in a close state of the dispenser, protrude from the dispensing opening.

With the above arrangement, each of the first and second threading openings may be configured so as to be relatively easy to thread. For example, the size of the first or second threading opening may be such that a tail may be easily grasped and pulled through at least a portion of the first or second threading opening. In particular, the extension of the first or second threading opening, may be selected to be greater than the extension of the dispensing opening. Accordingly, the two threading steps as outlined in the above may be perceived as being easier to perform than the single step of threading a tail of material into the relatively restricted dispensing opening.

With "partly overlapping" is meant that the openings overlap parts of each other, and the term is not to include completely overlapping relationships.

Optionally, in the closed state, the inner lid and the outer lid are arranged such that the remainder of the first threading opening is covered as seen from the outside of the dispenser by the outer lid, and the remainder of the second threading opening is covered as seen from the inside of the dispenser by the inner lid. Hence, the dispensing opening formed by the first and second dispensing opening portions may be the only opening extending through the outer lid and the inner lid, all the way between the roll compartment and the outside of the outer casing.

The dispensing opening forms a closed circumference at least as seen in a projection of said first and second dispensing opening portions on a plane perpendicular to the dispensing axis.

Optionally, the dispensing opening forms a closed circumference in a plane perpendicular to the dispensing axis.

Optionally, in a threading state of the dispenser, said outer lid is in an open position allowing access to said inner lid, such that said first threading opening is accessible for threading of a tail of material from a roll arranged in said roll compartment to said first dispensing opening portion.

With "the outer lid being in an open position" in the above is meant that the outer lid is not positioned outside the inner lid, as in the closed position where the outer lid forms a part of the closed outer casing. Instead, the outer lid is in an open position so as to allow access to the inner lid, and in particular to the first threading opening of the inner lid. The outer lid may be partially or completely detached from the remainder of the dispenser when in the open position.

The first threading step as outlined in the above may advantageously be performed when the dispenser is in such a threading state.

Optionally, the dispenser is provided with fastening elements configured for suspending the dispensing to a vertical wall. Optionally, said fastening elements are arranged opposite to said dispensing opening.

Optionally, in said threading state, said outer lid is in an open position, in which a tail of material protruding from the first dispensing opening portion is accessible for threading through said second threading opening. In this case, also the second step of the threading may be performed when the dispenser is in said threading state.

Optionally, the outer lid may however be brought to an open position in which a tail of material protruding from the first dispensing opening may be threaded through the second threading opening while moving the outer lid from the open position to the closed position, i.e. while moving the dispenser from the threading state to the closed state. Optionally, the dispenser may be arranged such that moving of the dispenser from the threading state to the closed state, e.g. by closing of a hinged outer lid, automatically results in a tail portion protruding from the first dispenser opening portion becoming threaded through the second threading opening.

Optionally, said first threading opening comprises a slit extending along at least one direction perpendicular to said dispensing axis towards said first dispensing opening portion. Hence, the first threading step implies threading of the tail through the first threading opening i.e. in a direction along the dispensing axis, such that the tail extends through the first threading opening, whereafter the tail of material may be moved in a direction or directions perpendicular to said dispensing axis along said slit, so as to position the tail of material at the first dispensing opening portion.

Optionally, said slit of the first threading opening is open towards a peripheral edge of the inner lid in a direction perpendicular to the dispensing axis. In this case, a tail of material may be brought from an outside of the periphery of the inner lid, in a direction perpendicular to the dispensing axis, and into the first threading opening. This may provide an easy and intuitive way of threading.

Optionally, the slit is relatively wider adjacent a peripheral edge of the inner lid and narrowing in a direction towards said first dispensing opening portion. A wider portion of the slit located adjacent a peripheral edge of the inner lid may be used either for threading a tail of material in in a direction along the dispensing opening, in which the wider portion should be configured to enable access to a roll behind the slit, or for easy introduction of a tail of material when threading a tail, which is already pulled past the inner lid along the dispensing axis, towards the first dispensing opening portion in a direction perpendicular to the dispensing axis. In both cases, the wider portion facilitates initial threading.

The narrower portion of the slit may provide a clear guide for the web material, by providing a relatively narrow guiding path. Also, the narrower portion may function so as to crimple the web material, enabling the web material to fit in the following first dispensing opening portion.

Optionally, the wider portion and the narrower portion of the slit may be configured to extend in generally different directions.

Optionally, the slit may comprise a curved portion.

Optionally, the first dispensing opening portion forms more than 50% of the perimeter of said dispensing opening, preferably more than 75%, most preferred 70 to 90%. This may be advantageous to enable a tail of web material to remain in the first dispensing opening portion, while a protruding part of said tail may be threaded through the second threading opening of the outer lid.

Optionally, said slit has a width across said inner lid adjacent said first dispensing opening portion being less than a width of the first dispensing opening portion. Again, this may be advantageous to enable a tail of web material to remain in the first dispensing opening portion, while a protruding part of said tail is may be threaded through the second threading opening of the outer lid.

Optionally, the second threading opening is defined by a rim defining a closed perimeter. This may be advantageous in that the outer lid may form a relatively large uninterrupted outer surface being a part of the outer casing, so as to provide the dispenser with a smooth outer surface, which may be advantageous in view of aesthetics and hygiene.

Optionally, an open area of said second threading opening as defined by a projection on a plane perpendicular to said dispensing axis may be less than 30% preferably less than, 20% of a total area of said outer lid as defined by a projection on the same plane.

Optionally, an open area enclosed by said rim of the second threading opening as defined by a projection on a plane perpendicular to said dispensing axis is at least 3× an open area of said dispensing opening as defined by a projection of said inner lid and said outer lid on a plane perpendicular to said dispensing axis, when the dispenser is in a closed state, preferably at least 5× said open area of said dispensing opening, most preferred at least 10× said open area of said dispensing opening.

Optionally, said inner lid comprises a nozzle portion forming said first dispensing opening portion. Nozzles may provide advantages in terms of dispensing, for example for providing sheet-by-sheet dispensing of perforated web material.

Optionally, the inner lid comprises a inner lid portion extending generally in a plane perpendicular to said dispensing axis, and said nozzle portion protrudes from said inner lid portion in a direction towards the outer lid, when the dispenser is in its closed state.

Optionally, said nozzle portion and said second threading opening of the outer lid are adapted to each other such that, when the dispenser is in a closed state, the nozzle portion is received in said second threading opening. In this case, the nozzle portion may be configured so as to form a smooth outer surface of the dispenser together with the outer lid. This may be advantageous from an aesthetic and hygienic point of view.

Preferably, the protruding nozzle portion and the second threading opening may form a close fit with each other, apart for at the location of the dispensing opening.

Optionally, the contour of the protruding nozzle portion and the rim of the second threading opening may be adapted to each other such that the protruding nozzle portion is received in said threading opening.

Optionally, said outer lid comprises a complementary nozzle portion, forming said second dispensing opening portion.

Optionally, said outer lid comprises an outer lid portion extending generally over a plane perpendicular to said dispensing axis, and said complementary nozzle portion protrudes from said outer lid portion in a direction towards the inner lid, when the dispenser is in its closed state.

Optionally, in said closed state of said dispenser, said outer casing is a closed outer casing apart from said dispensing opening.

Optionally, in said closed state of the dispenser, said inner lid is arranged inside said outer casing. In this case, the inner lid will not be visible from the outside, i.e. it will not affect the possibility for providing a smooth and closed outer appearance of the dispenser.

Optionally, the outer casing further comprises a housing, said housing defining a roll insertion opening configured for insertion of a roll of material into said housing, which roll insertion opening, when the dispenser is in a closed state, is covered by said outer lid.

In an open state, said roll insertion opening is accessible for introduction of a roll of material into said housing. In such an open state, the inner lid and the outer lid would be removed from said roll insertion opening.

Optionally, said roll insertion opening is configured for introduction of a roll of material along an insertion direction.

Optionally, said insertion direction is parallel to said dispensing axis.

Optionally, said roll compartment is generally cylindrical for receiving a roll. Optionally, a cylinder axis of said cylindrical roll compartment is generally parallel to said insertion direction. Optionally, a cylinder axis of said cylindrical roll compartment is generally parallel to said insertion direction and to said dispensing axis.

Optionally, the inner lid may extend over at least 20% of a side of the roll compartment configured for receiving an end of a roll, preferably over at least 50% of such a side.

Dispenser according to any one of the previous claims, wherein, in a threading state, the inner lid may be arranged so as to at least partially cover said roll insertion opening, and said outer lid is in an open position allowing access to said inner lid.

For example, the inner lid may be arranged so as to cover at least 20%, preferably at least 50% of the roll insertion opening.

Optionally in said threading state, said inner lid is configured to form a retrieval opening through which a tail of web material from a roll arranged in said housing is accessible for threading through said inner lid. Such a retrieval opening may be formed by the first threading opening. Optionally, such a retrieval opening may be formed outside the perimeter of the inner lid, e.g. between the perimeter of the inner lid and an inner wall of the housing.

Optionally, in said threading state, said outer lid is in a threading position, in which a tail of material protruding from the first dispensing opening portion is accessible for threading through said outer lid.

Optionally said outer lid and/or said inner lid is/are hinged to said housing.

Optionally, said housing comprises roll supports delimiting said roll compartment in directions perpendicular to said insertion direction.

Optionally, said housing comprises a curved support for vertically supporting said roll inside the roll compartment.

Optionally, in said closed and/or said threading state of the dispenser, the inner lid is arranged inside said housing.

Optionally, said inner lid comprises at least one releasable mechanical connector and said housing comprises at least one corresponding releasable mechanical connector, so as to enable releasable mechanical connection of said inner lid to said housing. Optionally, said releasable mechanical connectors may comprise hook portions for forming a releasable mechanical connection. Optionally, said releasable mechanical connectors may comprise snap fit portions for forming a releasable mechanical connection being a snap fit connection.

Optionally, the housing is provided with fastening elements configured for suspending the housing to a vertical wall. Optionally, said fastening elements are arranged on a side of the housing opposite to said insertion opening.

In a second aspect, there is provided the dispenser according to the first aspect, optionally including any combination of features as set out in the above, and comprising a roll of perforated absorbent paper web material in said roll compartment.

Optionally, said roll of perforated absorbent paper web material comprises perforations transverse to the web material, thus defining rectangular sheets with a width measured transverse the web material of the roll and a length measured along the web material of the roll. Optionally, the sheet width is greater than 100 mm, preferably greater than 125 mm. Optionally, the sheet width is between 100 mm and 180 mm, preferably between 125 mm and 180 mm.

Optionally, the ratio of the sheet width to its length is between 0.45 and 1, preferably between 0.5 and 0.65.

Optionally, the nozzle is configured for sheet-by-sheet dispensing particularly of web materials such as those mentioned in the above.

In a third aspect, there is provided a method for threading web material in a dispenser in accordance with any combination of features set out in the above comprising the steps of threading a tail of the web-shaped material from said roll through the inner lid via the first threading opening, in at least a direction perpendicular to said dispensing axis, to said first dispensing opening portion; and threading said tail of the web-shaped material present in said first dispensing opening portion through the outer lid via the second threading opening.

Optionally, the method may further comprise the preceding steps of:

moving the dispenser to an open state, in which said roll compartment is accessible, and arranging a roll of material therein;

moving the dispenser to a threading state, in which said roll compartment is delimited by said inner lid, and said outer lid is in an open position allowing access to said inner lid.

Optionally, the method further comprises the subsequent step of:

moving the dispenser to said closed state by arranging said outer lid in a closed position outside said inner lid, with said tail of web material present in the dispensing opening formed between said first and second dispensing opening portions.

Optionally, the steps of threading the tail of the web shaped-material through the outer lid via the second guide opening and moving the dispenser to the closed position may be performed simultaneously, since the threading may be performed simultaneously with the moving of the dispenser to closed state, e.g. by moving the outer lid from an open position to a closed position such that the tail present in the first dispensing opening portion is threaded through the second threading opening of the outer lid.

Further options and advantages of the aspects provided as disclosed herein are disclosed in the following description.

BRIEF DESCRIPTION OF THE DRAWINGS

Below follows a more detailed description of embodiments of dispensers with reference to the appended drawings, wherein.

Similar reference numbers denote similar details throughout the description.

DETAILED DESCRIPTION

Figure 1:
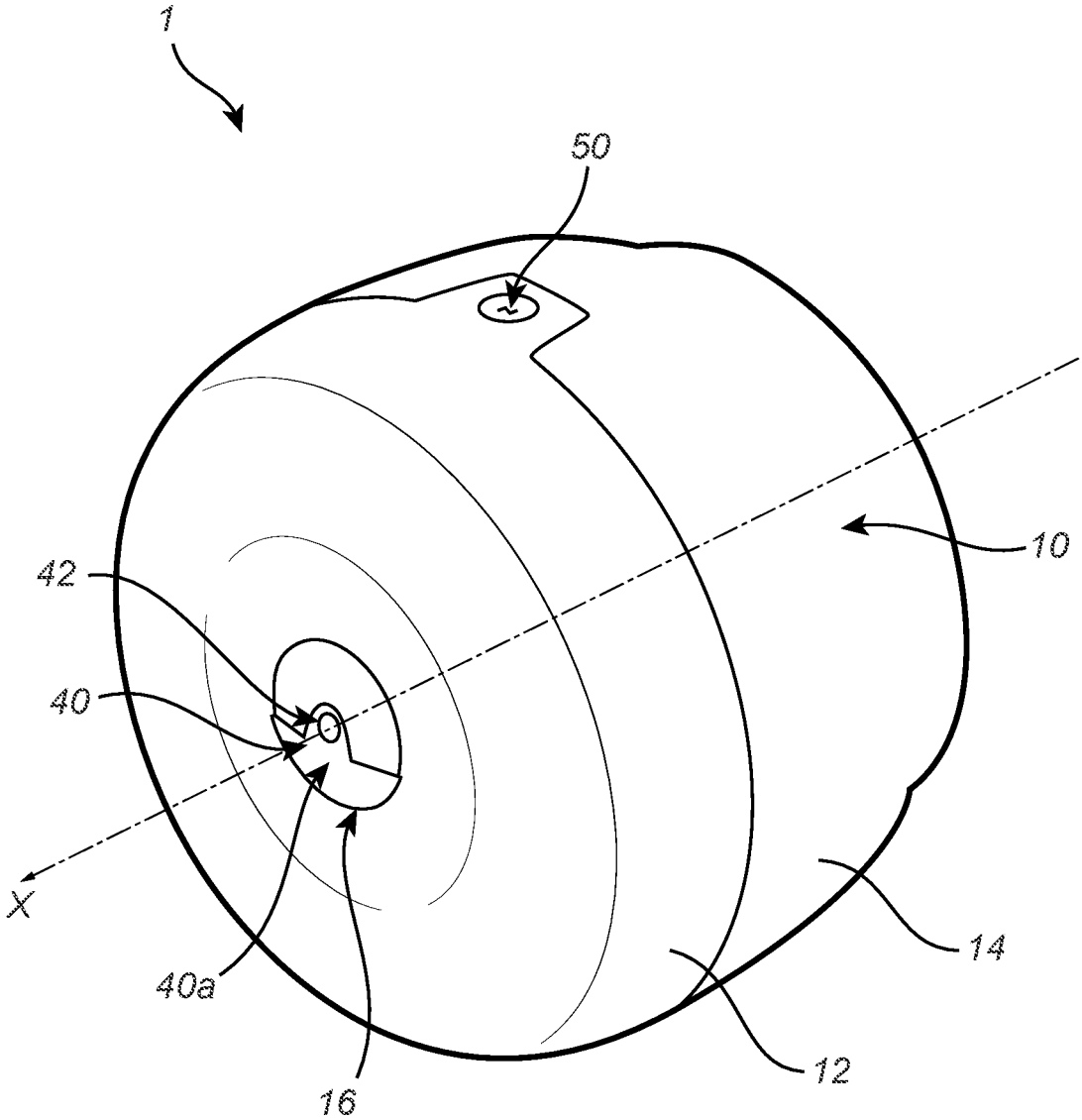
FIG. 1 is a perspective view of an example dispenser comprising an outer casing and a dispensing opening in a closed state.

FIG. 1 illustrates a preferred embodiment of a dispenser 1 for a roll 2 (see FIG. 3) of absorbent paper web material, e.g. toilet paper or household paper. Preferably, the roll 2 is a centre feed roll, i.e. a roll from which the absorbent paper web material is intended to be fed from an inner circumference of said roll 2. In particular, the roll 2 is a roll of perforated absorbent paper web material which comprises perforations transverse to the web material, thus defining rectangular sheets with a width measured transverse the web material of the roll 2 and a length measured along the web material of the roll 2. For example, the sheet width is between 100 mm and 180 mm, preferably between 125 mm and 180 mm, and the ratio of the sheet width to its length is between 0.45 and 1, preferably between 0.5 and 0.65.

In FIG. 1, the dispenser 1 is shown in a closed state, which is also a use state, meaning that the dispenser will be in said closed state for presenting web material to a user. As such, the dispenser 1 comprises an outer casing 10 enclosing a roll compartment 20 (see FIG. 2). The dispenser 1 comprises a dispensing opening 42 from which web material may be dispensed generally in a direction along a dispensing axis X of the dispenser. When the dispenser 1 is in use, a tail of web shaped material will protrude from the dispensing opening 42 allowing a user to grip and pull the tail to withdraw web material from the dispenser 1.

As may be gleaned from FIG. 1, the dispensing axis X is defined by the extension of the dispensing opening 42 from the roll compartment 20 to the outside of the outer casing 10. It will be understood, that with a dispensing axis X as defined by the extension of the dispensing opening 42, it will be possible for a user to pull a tail of the web material protruding from the dispensing opening 42 in directions being inclined with respect to said dispensing axis X, in order to withdraw web material from the dispenser 1. Generally however, for dispensing to take place, the tail would be pulled in a direction extending at least partly along the dispensing axis X.

As may be understood from FIG. 1, the dispensing opening 42 is configured to have a relatively small open area, hindering access to the roll compartment 20 inside the outer casing 10 via the dispensing opening 42. Hence, it is envisaged that the web material is torn off outside of the outer casing 10, such that it is ensured that, after dispensing of a portion of web material, a tail of web material remains protruding from the dispensing opening 42.

In particular, the dispenser 1 is configured for housing a roll of perforated web material, in which case the dispenser 1 may advantageously be configured for one-by-one dispensing of sheets from the perforated web material.

Optionally, and in the illustrated embodiment, the outer casing 10 is configured for attachment to a vertical wall. To this end, the outer casing 10 may comprise fastening elements (e.g. apertures or protrusions) intended to enable fastening of the outer casing 10 to a vertical wall. In particular, the dispenser 1 may be configured for suspension such that the dispensing axis X is generally horizontal.

Optionally, and as illustrated, any fastening elements of the outer casing 10 may be arranged at a side of the outer casing opposite to the dispensing opening 42.

Optionally, and in the illustrated embodiment, the outer casing 10 comprises an outer lid 12 and a housing 14. Optionally, and as illustrated, the housing 14 is provided with fastening elements as discussed in the above.

Figure 2:
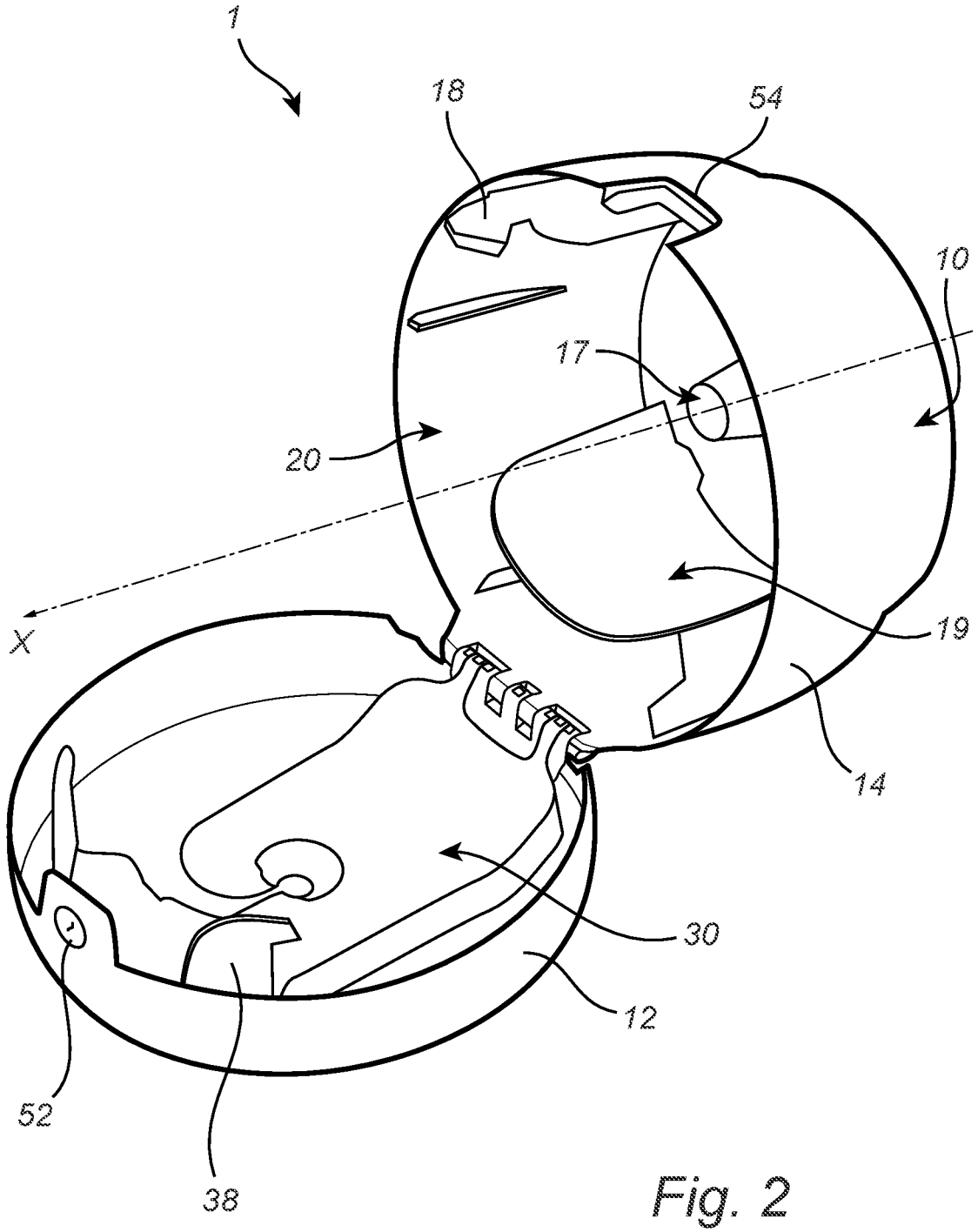
FIG. 2 is a perspective view of the dispenser of FIG. 1 in an open state.

FIG. 2 illustrates the dispenser of FIG. 1 when in an open state, where the outer lid 12 is in an open position, allowing access to the roll compartment 20 of the dispenser 1. As exemplified in FIG. 2, the housing 14 may comprise the roll compartment 20. The housing 14 may also form an insertion opening, configured for allowing insertion of a roll 2 of material into the roll compartment 20 along an insertion direction.

The open position of the outer lid 12 may be a position where the outer lid 12 is completely detached from the housing 14, or, as in the illustrated embodiment, the open position of the outer lid 12 is a position where the outer lid 12 is partially detached from the housing 14. In either case, the open position of the outer lid 12 is a position in which the outer lid 12 leaves the insertion opening of the housing 14 uncovered.

Advantageously, and as in the illustrated embodiment, the insertion direction may be parallel to the dispensing axis X.

Figure 3:
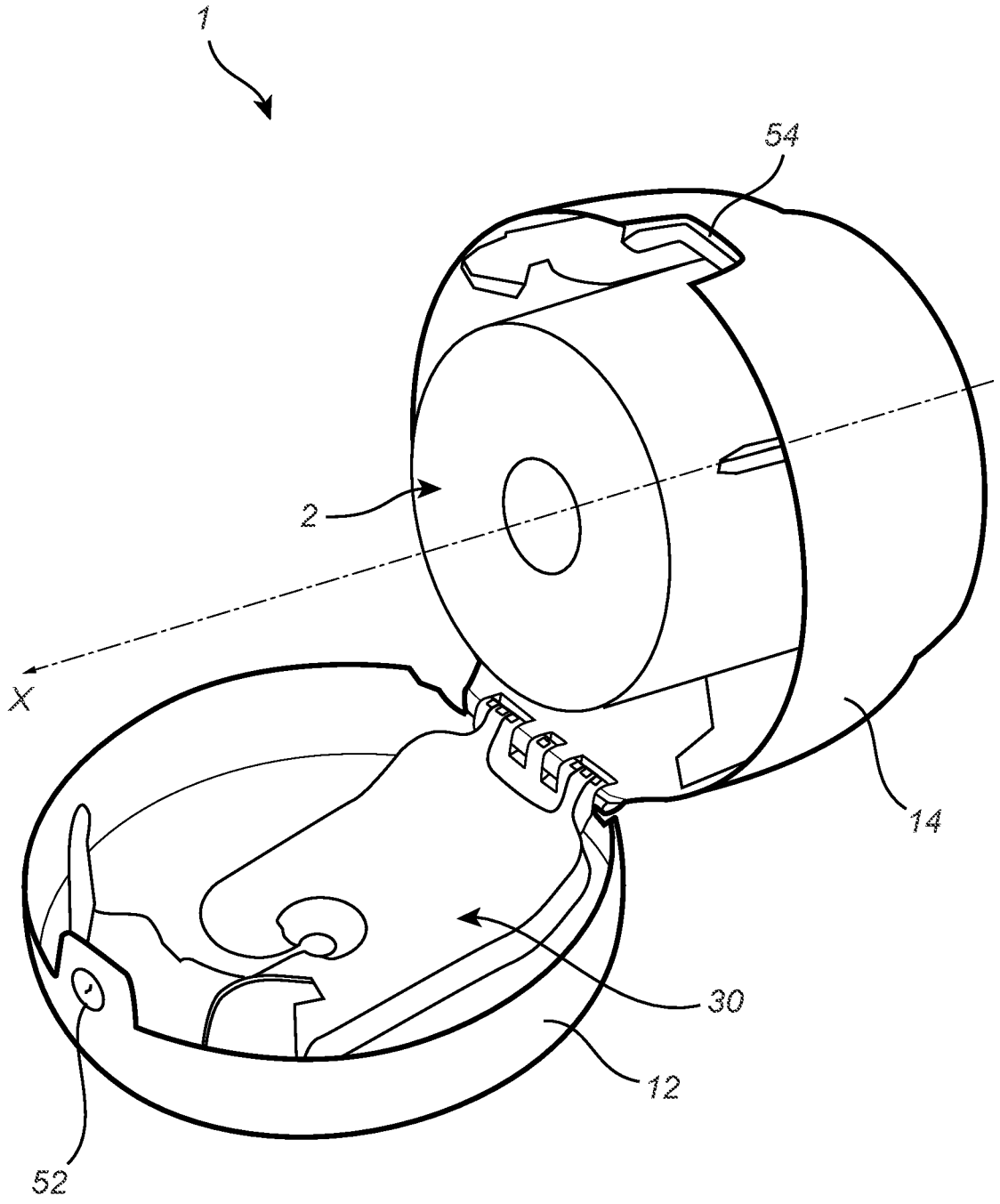
FIG. 3 is a perspective view of the dispenser of FIG. 1 in an open state and with a roll of material arranged in a roll compartment of the dispenser.

Further, the insertion direction may advantageously be parallel to a centre roll axis of a roll 2 to be inserted into the roll compartment 20 (see FIG. 3). The roll compartment 20 may have a generally cylindrical shape for receiving a roll 2, and said insertion direction may be parallel to a centre axis of said cylindrical shape. If desired, the housing 14 may also have a generally cylindrical shape, and optionally, a cylinder axis of said housing 14 may be parallel to the insertion direction and preferably also to the dispensing axis X.

Optionally, and as illustrated in FIG. 2, the housing 14 may comprise roll supports delimiting the roll compartment 20 in directions perpendicular to said insertion direction. For example, the housing 14 may comprise a curved support 19 for vertically supporting the roll 2 in the roll compartment 20. For example, the housing 14 may comprise a centre support 17 for supporting a roll 2 at its inner circumference, e.g. the centre support 17 may be configured to extend into the centre void of a coreless roll or into the core of a roll with a core.

FIG. 3 shows the dispenser 1 in an open state similar to the open state in FIG. 2, but with a roll 2 introduced in the roll compartment 20.

The dispenser 1 further comprises an inner lid 30, which in the closed state of the dispenser is located between the outer lid 12 and the roll compartment 20. In the open state of the illustrated dispenser (as illustrated in FIGS. 2 and 3) is located in an open position, similar to the outer lid 12. Hence, when the dispenser 1 is in an open state, the inner lid 30 is in an open position, allowing access to the roll compartment 20. The open position of the inner lid 30 may be a position where the inner lid 30 is completely detached from the housing 14, or, as in the illustrated embodiment, the open position of the inner lid 30 is a position where the inner lid 30 is partially detached from the housing 14. In either case, the open position of the inner lid 30 is a position in which the inner lid 30 leaves the insertion opening of the housing 14 uncovered.

Figure 4:
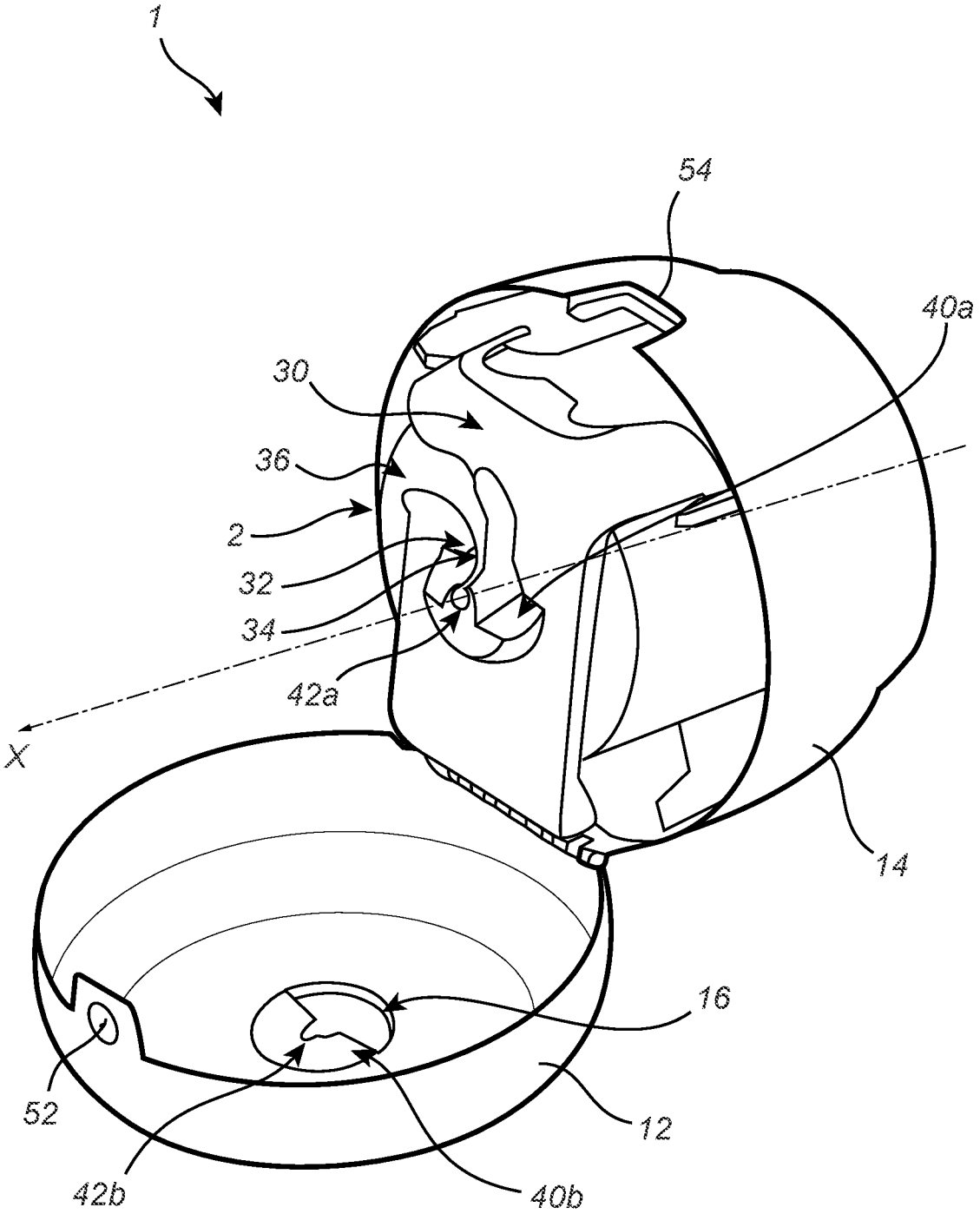
FIG. 4 is a perspective view of the dispenser of FIG. 1 in a threading state and with a roll of material arranged in a roll compartment of the dispenser.

FIG. 4 illustrates the dispenser 1 in a threading state, with a roll 2 arranged in the roll compartment 20. In the threading state, the outer lid 12 is, as in the open state, in an open position, allowing access to the inner lid 30. In the illustrated embodiment, the outer lid 12 when in its open position, leaves the insertion opening of the housing 14 uncovered. In the threading state, the inner lid 30 is arranged so as to delimit the roll compartment 20. In particular, in the threading state, the inner lid 30 remains in the same position relative to the housing 14 as in the open state. In the illustrated dispenser 1, the position of the inner lid 30 in the open state and in the threading state of the dispenser 1 is a position where the inner lid 30 is arranged so as to at least partly cover the insertion opening of the housing 14. As may be seen in FIG. 5, showing an exploded view of the dispenser 1 in a closed state, this position of the inner lid 30 is between the roll compartment 20 and the outer lid 12.

The inner lid 30 defines a first threading opening 32 through the inner lid 30. The first threading opening 32 comprises a slit 34 extending along at least one direction perpendicular to the dispensing axis X, towards a first dispensing opening portion 42*a*.

The outer lid 12 defines a second threading opening 16 through the outer lid 12. The second threading opening 16 comprises a second dispensing opening portion 42*b*.

Figure 5:
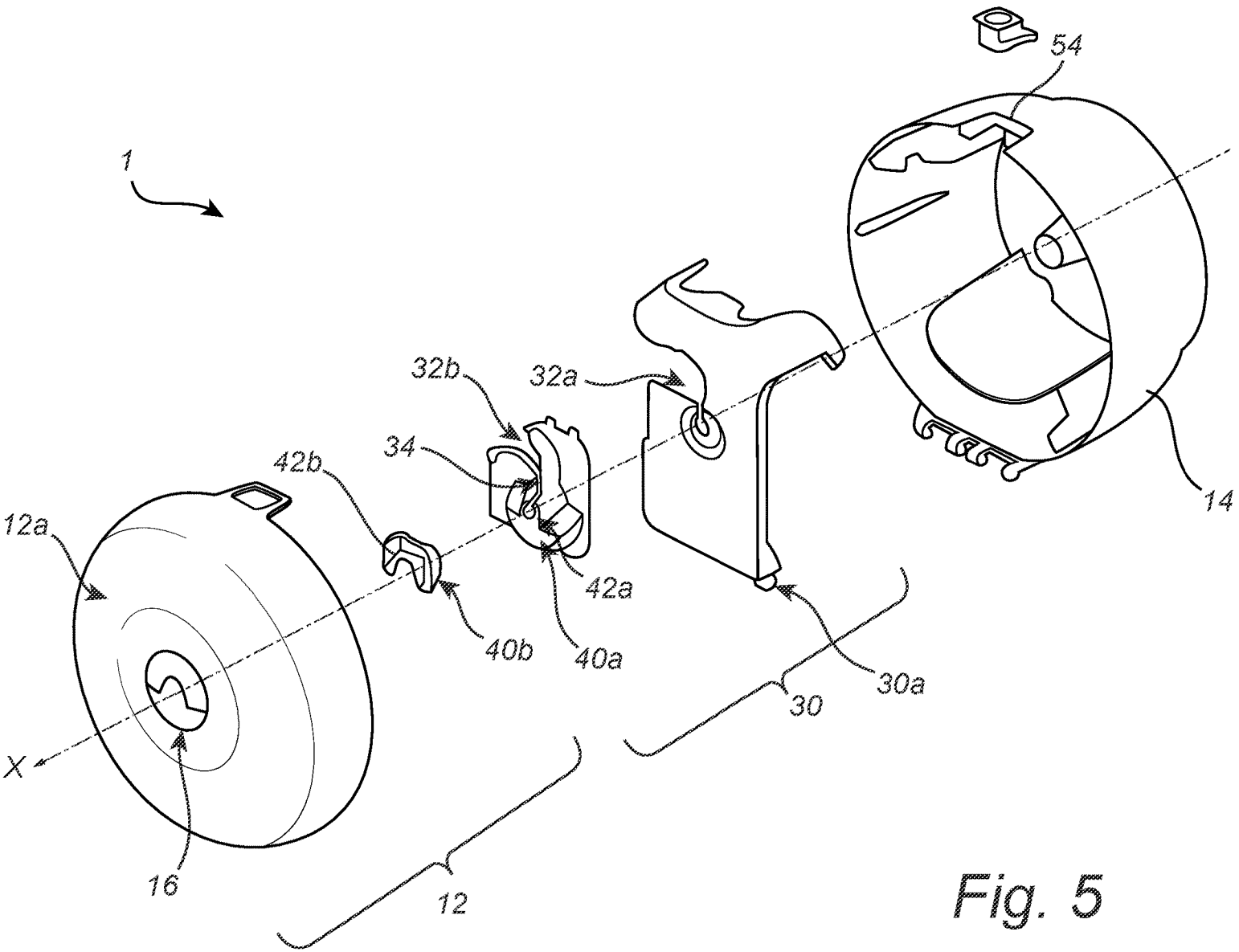
FIG. 5 is an exploded view of the dispenser of FIG. 1.

As seen in FIG. 5, when the dispenser is in the closed state, the first threading opening 32 and the second threading opening 16 are arranged in a partly overlapping relationship so as to form the dispensing opening 42 of the dispenser 1 by the first dispensing opening portion 42*a* and the second dispensing opening portion 42*b*.

In other words, the first threading opening 32 and the second threading opening 16 are partly overlapping at the first dispensing opening portion 42*a* and the second dispensing opening portion 42*b*, such that the first and second dispensing opening portions 42*a*, 42*b* together form the dispensing opening 42 of the dispenser 1.

In the closed state, the inner lid 30 and the outer lid 12 are arranged such that the remainder of the first threading opening 32 is covered as seen from the outside of the dispenser 1 by the outer lid 12, and the remainder of the second threading opening 16 is covered as seen from the inside of the dispenser 1 by the inner lid 30.

When the dispenser 1 is in the threading state as illustrated in FIG. 4, a tail of web material may be pulled from the roll 2 through the first threading opening 32 of the inner lid 30. In the illustrated embodiment, the tail may be pulled from the roll 2 via a retrieval opening 36 formed outside of the perimeter of the inner lid 30, between said perimeter and the housing 14. However, it will be understood that several options are available for enabling a user to draw a tail of web material through the first threading opening 32 of the inner lid 30. For example, a portion of the first threading opening 32 may be configured for enabling access to the web compartment 20 therethrough.

Once a tail of web material has been drawn through the first threading opening 32, i.e. to extend in the dispensing direction beyond the first inner lid 30, the tail may be brought sideways in a direction perpendicular to the dispensing axis X through the slit 34 of the first threading opening 32 to the first dispensing opening portion 42*a*.

Optionally, and as in the illustrated embodiment, the slit 34 of the first threading opening 32 is open towards a peripheral edge of the inner lid 30 in a direction perpendicular to the dispensing axis X, enabling easy threading of the tail of web material into the first threading opening 32.

Further, to enable easy threading, the slit 34 may as in the illustrated embodiment be relatively wide at the peripheral edge of the inner lid 30, and narrowing in a direction towards the first dispensing opening portion 42*a*. Accordingly, threading may be further facilitated.

Also, the web material may be crimpled as it is moved sideways from a wider portion of the slit 34 to a narrower portion of the slit 34, enabling it to fit through the first dispensing opening portion 42*a*.

Optionally, and as illustrated, the slit 34 may be curved. The curved slit 34 provides for easy threading without risk of rupturing the web material. Further, the curved slit 24 allows for an increased length of the slit 34 from a perimeter of the inner lid 30 to the first dispensing opening portion 42*a*. This increased length may be used e.g. for accomplishing the above-mentioned crimpling of the web material.

Advantageously, and as in the illustrated embodiment, the slit 34 may have a width across the inner lid 30 adjacent the first dispensing opening portion 42*a*, which is less than the width of the first dispensing opening portion 42*a*. In other words, the path through which the tail is threaded is relatively narrow just outside the first dispensing opening portion 42*a*, and then wider at the first dispensing opening portion 42*a*. Accordingly, once the tail of web material reaches the first dispensing opening portion 42*a*, the relatively narrow portion of the slit 34 may act so as to hinder the tail from accidentally leaving the first dispensing opening portion 42*a*, when the dispenser is in its threading state.

Moreover, the first dispensing opening portion 42*a* may advantageously form more than 50% of the total circumference of the dispensing opening 42. In the illustrated example, the first dispensing opening portion 42*a* forms more than 75% of the total circumference of the dispensing opening. This is another feature which enables the tail to remain in the first dispensing opening portion 42*a*, when the dispenser is in its threading state.

As seen in FIG. 4, in the threading state, the outer lid 12 is in an open position allowing access to the inner lid 30. In the illustrated embodiment, the outer lid 12 in the open position leaves the insertion opening of the housing 14 uncovered.

The outer lid 12 may, as in the illustrated dispenser be hinged to the housing 14. In this case, as seen in FIG. 4, in the threading state the outer lid 12 may remain in an open position in which the second threading opening 16 of the outer lid 12 is easily accessible. Hence, a user is able to pull a tail protruding from the first dispensing portion 42*a* of the inner lid 30 through the second threading opening 16 of the outer lid 12, which is in the open position.

Thereafter, the outer lid 12 may be arranged in its closed position outside of the inner lid 30, i.e. the dispenser may be brought to the closed state, bringing the tail to a position in between the first dispensing opening portion 42*a* of the first threading opening 32 and the second dispensing opening portion 42*b* of the second threading opening 16.

The second threading opening 16 of the outer lid 12 may advantageously be configured for easy threading of the tail of the web therethrough.

As exemplified in the illustrated dispenser 1, the second threading opening 16 may be defined by a rim defining a closed perimeter. The outer lid 12 may hence form an uninterrupted outer surface outside of said rim, which contributes to providing the dispenser 1 with a generally smooth outer appearance without unnecessary joints or edges. A smooth outer appearance, i.e. a smooth outer casing 10, may be beneficial for easy cleaning as well as being aesthetically pleasing.

As an example, the open area of the second threading opening 16 as defined by a projection on a plane perpendicular to the dispensing axis X may be less than 20% of a total area of the outer lid 12 as defined by a projection on the same plane.

In view of the above description, it will be understood that with a dispenser 1 as described herein, threading of web material through the dispenser 1 may be performed in two steps, both of which are relatively easy to perform for a user. In the first step, a tail of web material from a roll 2 contained in the roll compartment 20 is brought at least along a direction perpendicular to the dispensing axis X along the slit 34 of the first threading opening 32, to the first dispensing opening portion 42*a*. In the second step, the tail now protruding from the first dispensing opening portion 42*a* is threaded through the outer lid 12 via the second threading opening 16. In the first step, the slit 34 of the first threading opening 32 serves to guide the tail in at least a direction perpendicular to the dispensing axis X, so as to reach the first dispensing opening portion 42*a*. In the second step, the second threading opening 16 need not guide the tail in any direction perpendicular to the dispensing axis X. Instead, the second threading opening 16 provides for easy threading of the tail through the opening 16 when the dispenser 1 is in a threading state, and enables forming the dispensing opening 42 between the first and second dispensing opening portions 42*a*, 42*b*. The inner lid 30 and the outer lid 12 will in a closed state mutually cover the remainder of the first and second threading openings 32, 16 (the portions of the threading openings 32, 16 not forming the first and second dispensing opening portions 42*a*, 42*b*). Accordingly, it is possible to provide a dispenser 1 having a dispensing opening 42 with a relatively restricted open area, which provides for easy threading via a first and a second threading opening 32, 16 having relatively larger open areas.

In particular, a dispenser 1 may be configured such the threading steps may be performed by a user using one hand only to grasp the tail, and thread it through the first and the second threading openings 32, 16. Accordingly, a dispenser as proposed herein allows for single-hand threading.

For example, threading a tail through a first threading opening 32 by grasping a tail and then moving it sideways in a direction perpendicular to the dispensing axis X along the slit 34 of the first threading opening 32 may easily be performed as the tail is introduced into the slit 34 from a direction perpendicular to the extension of the web material.

For example, an open area enclosed by said rim of the second threading opening 16, as defined by a projection on a plane perpendicular to the dispensing axis X may be at least 5×, or even at least 10×, an open area of said dispensing opening 42 as defined by a projection of said inner lid 30 and said outer lid 12 on a plane perpendicular to said dispensing axis X. Accordingly, the size of the second threading opening 16 may be considerably larger than the size of the completed dispensing opening 42. Hence, it is understood that the treading a tail through said second threading opening 16 may be performed relatively easy, if compared to prior art dispensers in which the tail of the web material is to be manually threaded through a dispensing opening of a similar size as the dispensing opening 42 of the dispenser 1 described herein.

Optionally, and in the illustrated embodiment, the dispenser 1 comprises a nozzle 40. As mentioned in the above, a nozzle 40 comprising the dispensing opening 42 may be configured to provide for easy dispensing of web material, in particular for sheet-by-sheet dispensing of perforated web material.

As exemplified in the illustrated embodiment, the inner lid 30 may comprise a nozzle portion 40*a* forming the first dispensing opening portion 42*a*.

To complement the nozzle portion 40*a* of the inner lid 30, the outer lid 12 may comprise a complementary nozzle portion 40*b*, forming the second dispensing opening portion 42*b*.

Since, as described in the above, the first dispensing opening portion 42*a* may form a majority of the perimeter of the dispensing opening portion 42, the nozzle portion 40*a* may also form the majority of the nozzle 40.

As exemplified in the illustrated embodiment, the inner lid may comprise an inner lid portion 30*a* extending generally over a plane perpendicular to the dispensing axis X, and a nozzle portion 40*a* protruding from said inner lid portion 30*a* in a direction towards the outer lid 12, when the dispenser is in a closed state.

In the illustrated embodiment, and as is best seen in FIG. 5, the inner lid portion 30*a* and the nozzle portion 40*a* are formed by separate parts which in an assembled condition form the inner lid 30. However, it will be understood that the inner lid portion 30*a* and the nozzle portion 40*a* could alternatively be formed as portions of a single piece forming the inner lid 30. However, providing different parts as exemplified in the illustrated embodiment may be advantageous since it allows for selection of different materials for the inner lid portion 30*a* and the nozzle portion 40*a*, if desired.

In a similar manner, the outer lid 12 may comprise an outer lid portion 12*a* extending generally over a plane perpendicular the dispensing axis X, and a complementary nozzle portion 40*b* which protrudes from the outer lid portion 12*a* in a direction towards the inner lid 30, when the dispenser is its closed state. In the illustrated embodiment, the outer lid portion 12*a* and the complementary nozzle portion 40*b* are formed by separate parts which in an assembled condition form the inner lid 30. However, it will be understood that the outer lid portion 12*a* and the complementary nozzle portion 40*b* could alternatively be formed as parts of a single piece forming the outer lid 12.

When the inner lid 30 and/or the outer lid 12 is formed by separate parts, such parts may be designed to form various features of the inner lid 30 and/or the outer lid 12, respectively. For example, in the illustrated embodiment, the inner lid 30 is formed by a first inner lid part comprising the inner lid portion 30*a* and a first part threading opening 32*a*, and a second inner lid part comprising the nozzle portion 40*a* and a second part threading opening 32*b*, and, in an assembled condition of the inner lid 30, the first threading opening 32 is defined by the assembled first and second part threading openings 32*a*, 32*b*.

Preferably, and as exemplified, the nozzle portion 40*a* of the inner lid 30 and the second threading opening 16 of the outer lid 12 may be adapted to each other such that, when the dispenser 1 is in a closed state, the nozzle portion 40*a* is received in the second threading opening 16.

In more detail, the contour of the protruding nozzle portion 40*a* and the rim of the second threading opening 16 may be adapted to each other such that the nozzle portion 40*a* is received in the threading opening 16. (See FIG. 1)

As seen in FIG. 1, this enables forming a smooth outer surface of the dispenser 1. In particular, the surface of the nozzle portion 40*a* being exposed the outside of the dispenser 1 when in a closed state may be levelled with the surrounding rim of the second threading opening 16.

Moreover, in order to provide the dispenser 1 with a smooth outer surface, it may be desired that in the closed state of the dispenser, the outer casing is a closed casing 10, apart form said dispensing opening 42. In other words, the dispensing opening 42 is the only opening from the roll compartment 20 to the outside of the outer casing 10, at least which is accessible when the dispenser 1 is mounted as intended, e.g. when the dispenser 1 is mounted on a vertical wall.

Optionally, and as in the illustrated embodiment, the inner lid 30 is arranged inside the outer casing 10, in this case inside the housing 14. Accordingly, the single joint between the outer lid 12 and the housing 14 may be the only joint in the outer casing 10 necessary to enable insertion of new rolls into the dispenser, and to provide for the open state and the threading state of the dispenser. Moreover, in this case the inner lid 30 will not be visible from the outside of the dispenser 1, which enables greater freedom for selecting e.g. material for the inner lid 30.

The inner lid 30 may be hinged to the housing as exemplified in the illustrated embodiment. Alternatively or in addition to a hinge, the inner lid 30 may comprise at least one releasable mechanical connector and the housing 14 at least one corresponding releasable mechanical connector. In the illustrated example, the housing 14 and the inner lid 30 comprises releasable mechanical connectors 18, 38 arranged generally opposite a hinge. In the illustrated embodiment, the releasable mechanical connectors 18, 38 are formed by the housing 14 comprising two hooks 18 which form releasable mechanical connections with corresponding hooks 38 of the inner lid 30. In the illustrated embodiment, the mechanical connectors 18 are arranged generally opposite a hinge. However, variants are conceivable for example where the hinge is replaced by another mechanical connection. Also, other connections than the illustrated hooks are conceivable, such as snap-fit connectors, or frictional connectors.

Advantageously, and as in the illustrated dispenser, the dispenser may comprise a lock 50 for locking the dispenser 1 in said closed condition. In the illustrated dispenser, a lock 50 is provided locking the outer lid 12 to the housing 14. To this end, a locking housing 52 is arranged at the outer lid 12, which engages with a corresponding locking edge 54 of the housing 14.

The outer lid 12 of the dispenser 1 may be opened to set the dispenser 1 to its threading state not only when there is a need for replacing a depleted roll 2 in the roll compartment 20. The outer lid 12 of the dispenser 1 may be opened to set the dispenser 1 to its threading state also in case of an unintended web breakage during dispensing, causing a need to re-thread the dispenser. Also, the outer lid 12 of the dispenser 1 may be opened to set the dispenser 1 to its threading state if it is desired to visually check the amount of web material remaining on a roll 2 in the roll compartment 20.

When the outer lid 12 of the dispenser is opened while a tail of web material protrudes from the dispensing opening 42, the second threading opening 16 allows for the outer lid 12 to be moved from its closed position adjacent the inner lid 30 to an open position without dragging the tail of the web material along with the outer lid 12. Instead, the tail remains in position in the first threading opening 32, i.e. at the first dispensing opening portion 42*a*. Hence, e.g. after checking the remaining amount of web material in the dispenser, the outer lid 12 may be closed, and the dispenser 1 reset to its closed state without need for rethreading the dispenser 1.

Optionally, the inner lid 30 may be configured to stabilise the roll 2 inside the roll compartment 20. For example, the inner lid 30 may be provided with protrusions extending towards the roll compartment 20 for stabilising the roll 2 in the roll compartment 20. That the inner lid 30 stabilises the roll may in particular hinder collaps of a roll 2 from which a significant amount of web material has already been dispensed. Hence, the outer lid 12 may be opened (i.e. the dispenser 1 is brought to the threading state) e.g. for checking the level of web material remaining on the roll, or for threading after an unintended web breakage during dispensing, without risk of the roll 2 inside the dispenser 1 collapsing.

To this end, the inner lid 30 may extend over at least 20% of the area of the insertion opening, preferably over at least 50% of the area of the insertion opening. Or, differently put, the inner lid 30 may extend over at least 20% of a side of the roll compartment configured for receiving an end of a roll, preferably over at least 50% of such a side.

Figure 6:
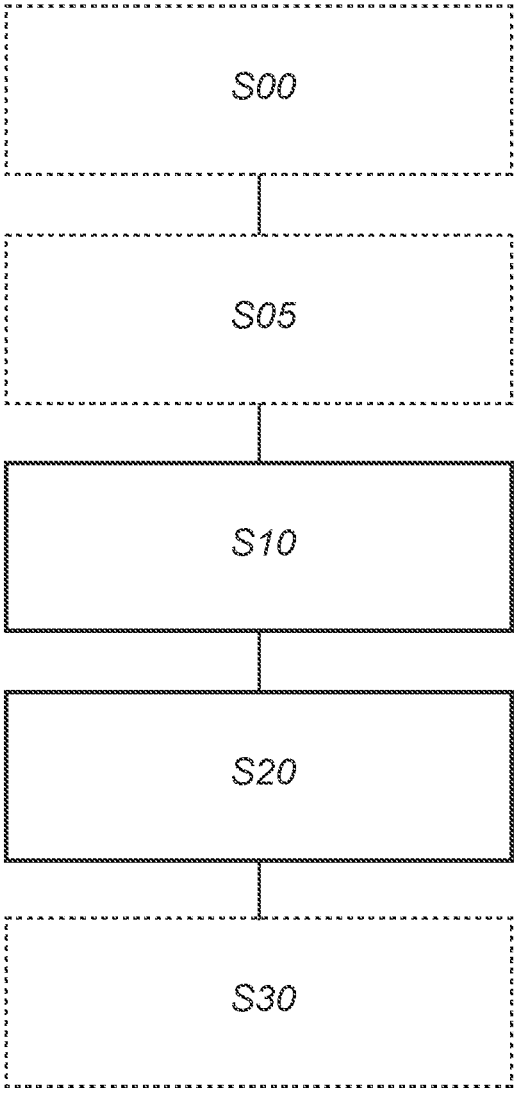
FIG. 6 is a flow chart illustrating a method for threading web material in a dispenser.

With reference to FIG. 6, a method for threading web material in a dispenser 1 as suggested herein comprises the steps of (S10) threading a tail of the web-shaped material from said roll through the inner lid 30 via the first threading opening 32 to said first dispensing opening portion 42*a*; and (S20) threading said tail of the web-shaped material present in said first dispensing opening portion 42*a* through the outer lid 12 via the second threading opening 16.

In a more detailed version, the method comprises the steps of (S00) moving the dispenser 1 to an open state, in which said roll compartment 20 is accessible, and arranging a roll 2 of web-shaped material therein;

(S05) moving the dispenser to a threading state, in which said roll compartment 20 is delimited by said inner lid 30, and said outer lid 12 is in an open position;

(S10) threading a tail of the web-shaped material from said roll 2 through the inner lid 30 via the first threading opening 32, in at least a direction perpendicular to said dispensing axis X along said slit 34, and to said first dispensing opening portion 42*a*; and (S20) threading said tail of the web-shaped material present in said first dispensing opening portion 42*a* through the outer lid 12 via the second threading opening 16, (S30) moving the dispenser to said closed position by arranging said outer lid 12 outside said inner lid 30, with said tail of web material present in the dispensing opening 42 formed between said first and second dispensing opening portions 42*a*, 42*b*.

Numerous variants and options of the dispensers and methods as disclosed herein will be conceivable by the person skilled in the art. In particular, although the above description is made with reference to a dispenser comprising one roll compartment for dispensing of web material from one roll through a dispensing opening, the content thereof is equally applicable to a dispenser comprising two roll compartments for dispensing of web material from two rolls, one roll being arranged in each roll compartment, via two dispensing openings (one dispensing opening per roll/roll compartment). Also, the above description of a dispenser is focused on a dispenser wherein the inner lid and the outer lid are arranged in front of an insertion opening for introducing a roll of material to the dispenser.

Other variants are conceivable wherein the insertion opening for introducing a roll of material to the dispenser is located elsewhere in the dispenser. For example, the roll of material could be introduced via a backside of the dispenser, opposite the side of the dispenser comprising the dispensing opening. In such variants, the inner lid need not be movable to an open position, but may be fixed in a position delimiting the roll compartment of the housing.

The invention claimed is:

1. A dispenser for a roll of rolled up absorbent paper web material, said dispenser, in a closed state, comprising:

an outer casing enclosing a roll compartment for housing a roll, and a dispensing opening extending from the roll compartment to an outside of said outer casing along a dispensing axis of the dispenser, said outer casing comprising an outer lid assuming a closed position when the dispenser is in said closed state;

a support member provided within said outer casing extending from a rear surface of the outer casing that is opposite the outer lid and arranged to extend into a center void of the roll of rolled up absorbent paper web to support the roll of paper web material within the outer casing;

said dispenser further comprising an inner lid, which, in said closed state of the dispenser, is arranged between said roll compartment and said outer lid, said inner lid being hinged to the dispenser so that it can pivot relative to the outer lid;

said inner lid defines a first threading opening through said inner lid along said dispensing axis, said first threading opening comprising a first dispensing opening portion; and said outer lid defines a second threading opening through said outer lid along said dispensing axis, said second threading opening comprising a second dispensing opening portion;

and, when the dispenser is in said closed state, said first threading opening and said second threading opening are arranged in a partly overlapping relationship so as to form said dispensing opening by said first dispensing opening portion and said second dispensing opening portion;

wherein said first threading opening comprises a slit extending along at least one direction perpendicular to said dispensing axis towards said first dispensing opening portion, and said slit is open towards a peripheral edge of the inner lid in a direction perpendicular to the dispensing axis; and wherein the dispenser is configured for suspension such that the dispensing axis is generally horizontal.

2. The dispenser according to claim 1, wherein, in a threading state of said dispenser, said outer lid is in an open position allowing access to said inner lid, such that said first threading opening is accessible for threading of a tail of material from a roll arranged in said roll compartment through said first threading opening to said first dispensing opening portion.

3. The dispenser according to claim 2, wherein, in said threading state, when said outer lid is in an open position, said second threading opening is accessible such that threading of a tail of material protruding from the first dispensing opening portion of the inner lid through said second threading opening is enabled.

4. The dispenser according to claim 1, comprising a roll of perforated absorbent paper web material.

5. The dispenser according to claim 1, wherein the support member is provided within said outer casing parallel to the dispensing axis.

6. The dispenser according to claim 1, wherein said slit is relatively wider adjacent towards a peripheral edge of the inner lid and narrowing in a direction towards said first dispensing opening portion.

7. The dispenser according to claim 1, wherein said first dispensing opening portion forms more than 50% of a perimeter of said dispensing opening.

8. The dispenser according to claim 1, wherein said slit has a width across said inner lid adjacent said first dispensing opening portion, being less than a maximum width of the first dispensing opening portion.

9. The dispenser according to claim 1, wherein said second threading opening is defined by a rim defining a closed perimeter.

10. The dispenser according to claim 9, wherein an open area enclosed by said rim of the second threading opening as defined by a projection on a plane perpendicular to said dispensing axis is at least three times an open area of said dispensing opening as defined by a projection of said inner lid and said outer lid on a plane perpendicular to said dispensing axis, when the dispenser is in said closed state.

11. The dispenser according to claim 1, wherein said inner lid comprises a nozzle portion forming said first dispensing opening portion.

12. The dispenser according to claim 11, wherein said inner lid comprises an inner lid portion extending generally in a plane perpendicular to said dispensing axis, and said nozzle portion protrudes from said inner lid portion in a direction towards the outer lid, when the dispenser is in said closed state.

13. The dispenser according to claim 12, wherein when the dispenser is in said closed state, the nozzle portion is received in said second threading opening.

14. The dispenser according to claim 12, wherein said outer lid comprises a complementary nozzle portion, forming said second dispensing opening portion.

15. The dispenser according to claim 14, wherein said outer lid comprises an outer lid portion extending generally over a plane perpendicular to said dispensing axis, and said complementary nozzle portion protrudes from said outer lid portion in a direction towards the inner lid, when the dispenser is in said closed state.

16. The dispenser according to claim 1, wherein, in said closed state of said dispenser, said outer casing forms a closed outer casing being open to the roll compartment only at said dispensing opening.

17. The dispenser according to claim 1 wherein, in said closed state of the dispenser, said inner lid is arranged inside said outer casing.

18. The dispenser according to claim 1, wherein the outer casing further comprises a housing, said housing defining a roll insertion opening configured for insertion of a roll of material into said housing, wherein the roll insertion opening, when the dispenser is in said closed state, is covered by said outer lid.

19. The dispenser according to claim 18, wherein, in an open state of said dispenser, said roll insertion opening is accessible for introduction of a roll of material into said housing.

20. The dispenser according to claim 18, wherein, in a threading state, the inner lid is arranged so as to at least partially cover said roll insertion opening, and said outer lid is an open position allowing access to said inner lid.

21. The dispenser according to claim 18, wherein said outer lid is hinged to said dispenser.

22. The dispenser according to claim 20, wherein, in said threading state, said inner lid is configured to provide a retrieval opening through which a tail of web material from a roll arranged in said roll compartment is accessible for threading through said inner lid in a direction along the dispensing axis.

23. A method for threading web material in a dispenser in accordance with claim 1 comprising the steps of threading a tail of the web-shaped material from said roll through the inner lid via the first threading opening to said first dispensing opening portion; and threading said tail of the web-shaped material present in said first dispensing opening portion through the outer lid via the second threading opening.

24. The method according to claim 23, further comprising the preceding steps of:

moving the dispenser to an open state, in which said roll compartment is accessible, and arranging a roll of material therein;

moving the dispenser to a threading state, in which said roll compartment is delimited by said inner lid, and said outer lid is in an open position allowing access to said inner lid.

25. The method according to claim 23, further comprising the subsequent step of:

moving the dispenser to said closed state by arranging said outer lid in a closed position outside said inner lid, with said tail of web material present in the dispensing opening formed between said first and second dispensing opening portions.

26. The method according to claim 23, wherein said step of threading a tail of the web-shaped material from said roll through the inner lid via the first threading opening, comprises threading said tail in at least a direction perpendicular to said dispensing axis, towards said first dispensing opening portion, said step comprises threading said tail along said slit in at least a direction perpendicular to said dispensing axis, towards said first dispensing opening portion.

27. A dispenser for a roll of rolled up absorbent paper web material, said dispenser, in a closed state, comprising:

an outer casing enclosing a roll compartment for housing a roll, and a dispensing opening extending from the roll compartment to an outside of said outer casing along a dispensing axis of the dispenser, said outer casing comprising an outer lid assuming a closed position when the dispenser is in said closed state;

said dispenser further comprising an inner lid, which, in said closed state of the dispenser, is arranged between said roll compartment and said outer lid, said inner lid being hinged to the dispenser so that it can pivot relative to the outer lid;

said inner lid defines a first threading opening through said inner lid along said dispensing axis, said first threading opening comprising a first dispensing opening portion; and said outer lid defines a second threading opening through said outer lid along said dispensing axis, said second threading opening comprising a second dispensing opening portion;

and, when the dispenser is in said closed state, said first threading opening and said second threading opening are arranged in a partly overlapping relationship so as to form said dispensing opening by said first dispensing opening portion and said second dispensing opening portion;

wherein said first threading opening comprises a slit extending along at least one direction perpendicular to said dispensing axis towards said first dispensing opening portion, and said slit is open towards a peripheral edge of the inner lid in a direction perpendicular to the dispensing axis; and wherein said outer lid and said inner lid are separately hinged to said dispenser at a same portion of the dispenser, said outer lid and said inner lid having a same pivot axis.

28. The dispenser according to claim 27, wherein the dispenser is configured for suspension such that the dispensing axis is generally horizontal.

29. The dispenser according to claim 27, further comprising a support member provided within said outer casing extending from a rear surface of the outer casing that is opposite the outer lid and arranged to extend into a center void of the roll of rolled up absorbent paper web to support the roll of paper web material within the outer casing.

* * * * *